US011851836B2

(12) United States Patent
Barnes

(10) Patent No.: US 11,851,836 B2
(45) Date of Patent: Dec. 26, 2023

(54) PILE GUIDE CONSTRUCT FOR DOCKS

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 0 days.

(21) Appl. No.: 17/577,736

(22) Filed: Jan. 18, 2022

(65) Prior Publication Data

US 2023/0228053 A1 Jul. 20, 2023

(51) Int. Cl.
*E02B 3/06* (2006.01)

(52) U.S. Cl.
CPC ..... *E02B 3/064* (2013.01); *E02B 3/062* (2013.01); *E02B 3/068* (2013.01)

(58) Field of Classification Search
CPC . E02B 3/06; E02B 3/062; E02B 3/064; E02B 3/066; E02B 3/068
USPC ..... 405/211, 216, 218, 219, 220, 221
See application file for complete search history.

(56) References Cited

U.S. PATENT DOCUMENTS

| | | | | |
|---|---|---|---|---|
| 3,074,239 | A | 1/1963 | Mustard | |
| 3,270,698 | A | 9/1966 | Fort | |
| 3,319,328 | A * | 5/1967 | Finger | H02G 7/00 174/45 R |
| 3,448,585 | A * | 6/1969 | Vogelsang | E02D 5/60 52/515 |
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,110,989 | A * | 9/1978 | Selkirk | E02D 5/32 405/255 |
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |

(Continued)

FOREIGN PATENT DOCUMENTS

| | | |
|---|---|---|
| DE | 2042850 | 3/1972 |
| FR | 3017595 | 6/2014 |
| WO | WO2014035026 | 3/2014 |

OTHER PUBLICATIONS https://www.jetdock.com (excerpt printed Jan. 29, 2020).

(Continued)

*Primary Examiner* — Frederick L Lagman
(74) *Attorney, Agent, or Firm* — B. Craig Killough

(57) ABSTRACT

A pile guide construct for floating docks. An elongated and vertical sleeve is positioned over a pile that is driven into the earth. A guide is positioned over the elongated and vertically positioned sleeve. A limiting cap is positioned an upper end of the sleeve that acts as a stop to prevent the guide from exceeding a vertical height that is greater than the height of the pile. Forming the sleeve and guide of thermoplastic, such as high density polyethylene, provides a sleeve and guide that are both durable and corrosion resistant, while also providing a construct having a low coefficient of friction that facilitates vertical movement of the guide relative to the sleeve and the pile. A collar mounted to the sleeve and spaced apart from the limiting cap may also be provided to provide a lower limit of travel of the dock relative to the pile.

19 Claims, 6 Drawing Sheets

(56) References Cited

U.S. PATENT DOCUMENTS

| | | | | |
|---|---|---|---|---|
| 4,923,336 | A * | 5/1990 | Schmidt | E02B 3/068 405/219 |
| 5,002,000 | A | 3/1991 | Rutter | |
| 5,016,551 | A | 5/1991 | Peck et al. | |
| 5,046,897 | A | 9/1991 | Ray | |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 6,145,463 | A | 11/2000 | Zeilinger | |
| 6,179,525 | B1 | 1/2001 | Gruhn et al. | |
| 6,477,968 | B2 | 11/2002 | Powell | |
| 6,526,902 | B1 | 3/2003 | Faber | |
| 6,547,485 | B2 | 4/2003 | Elson | |
| D506,668 | S | 6/2005 | Black | |
| 7,153,064 | B2 | 12/2006 | Zeilinger et al. | |
| 7,390,141 | B2 * | 6/2008 | Rytand | E02B 3/06 405/23 |
| 7,406,924 | B1 | 8/2008 | Impey | |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 | 4/2019 | Barnes et al. | |
| 10,370,073 | B2 | 8/2019 | Barnes | |
| 10,822,063 | B1 | 11/2020 | Barnes | |
| 11,008,720 | B2 * | 5/2021 | Kirby | E02B 3/24 |
| 11,535,995 | B2 * | 12/2022 | Barnes | E02B 3/28 |
| 2002/0131821 | A1 | 9/2002 | Elson | |
| 2004/0240943 | A1 * | 12/2004 | Brensinger | E02D 5/60 405/211.1 |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0248420 | A1 | 10/2007 | Jacobs et al. | |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2013/0087089 | A1 * | 4/2013 | Lill | B63B 21/00 114/263 |
| 2013/0309021 | A1 * | 11/2013 | Rowley | B63C 1/02 405/216 |
| 2014/0010593 | A1 | 1/2014 | Davis | |
| 2018/0266066 | A1 * | 9/2018 | Barnes | E02B 3/064 |
| 2020/0115867 | A1 * | 4/2020 | Kirby | E02B 3/064 |
| 2020/0370261 | A1 * | 11/2020 | Barnes | E02B 3/28 |
| 2021/0039761 | A1 * | 2/2021 | Barnes | B63B 35/38 |
| 2021/0214059 | A1 | 7/2021 | Barnes | |

OTHER PUBLICATIONS

Shoremaster, LLC, Official RhinoHoist Front Mount Floating Boat Life Video, YouTube, May 10, 2013, https://www.youtube.com/watch?v-ayxgoTHCijl.

* cited by examiner

PILE GUIDE CONSTRUCT FOR DOCKS

BACKGROUND OF THE INVENTION

Pile guides are used to attach docks and structures associated with docks, such as walkways, to piles that are driven into the earth. The pile guides connect the dock to the piles, and permit vertical movement of the dock relative to the piles, but substantially prevent horizontal movement of the dock relative to the piles. Docks, as contemplated hereby, are floating docks that float and move vertically due to water level changes, such as tidal changes or changes to lake water levels.

Currently, there is no pile guide construct that limits the upper vertical travel of the dock, excepting perhaps docks that have structures attached to the top of the piles. However, in such cases, the structures are not specifically designed for limiting vertical travel of the dock, and may be damaged by excessive vertical travel of the dock.

Excessive vertical travel of the dock may occur during storms where substantial wave action is present, or during flooding or tidal activity. There is a need for a pile guide construct that works efficiently in permitting desired vertical travel of the dock and related structures, but which limits vertical travel, so that the dock is not restrained by the piles. Stated otherwise, without a limiting device, the dock may incur vertical movement that allows the pile guide to exceed the height of the pile so that the dock is no longer attached to the pile.

SUMMARY OF THE INVENTION

The present invention is a pile guide construct for floating docks. An elongated and vertical sleeve is positioned over a pile that is driven into the earth. The pile and sleeve extend above the surface of the water of a body of water. A guide is positioned over the elongated and vertically positioned sleeve. The guide vertically traverses the elongated sleeve. The guide is mounted to a dock. The guide moves vertically relative to the pile and the sleeve that is positioned over the pile. The guide limits horizontal movement of the dock by surrounding the pile and the sleeve. The use of multiple guides and multiple piles and sleeves allows vertical movement of the dock, but limits horizontal movement of the dock. A collar mounted to the sleeve and spaced apart from the limiting cap may also be provided to provide a lower limit of travel of the dock relative to the pile.

A limiting cap is positioned at an upper end of the sleeve. The limiting cap has a size that acts as a stop to prevent the guide from exceeding a vertical height. Forming the sleeve and guide of thermoplastic, such as high density polyethylene, provides a sleeve and guide that are both durable and corrosion resistant, while also providing a construct having a low coefficient of friction that facilitates vertical movement of the guide relative to the sleeve and the pile. Smooth plastic surfaces also resist barnacle growth. A collar mounted to the sleeve and spaced apart from the limiting cap may also be provided to provide a lower limit of travel of the dock relative to the pile.

BRIEF DRAWING DESCRIPTION

DESCRIPTION OF PREFERRED EMBODIMENTS

Figure 2:
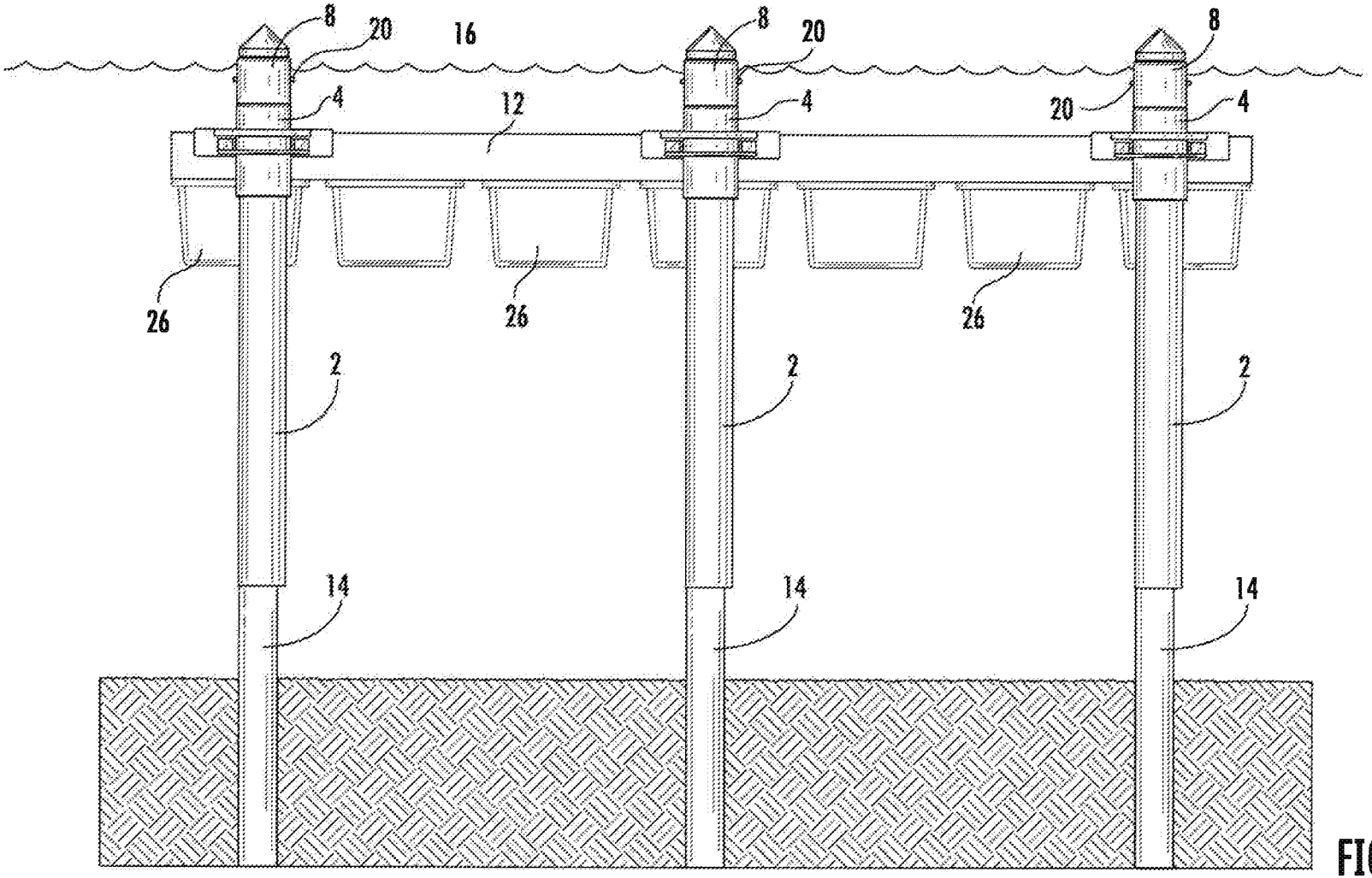
FIG. 2 shows an elevation of a dock having the pile guide construct according to the invention, with the water surface above the dock.

FIG. 2 shows a floating dock 12 that is held in a position by means of piles 14 that limit horizontal movement of the dock. The piles are driven into earth and extend vertically to above the surface of the water. Floats 26 may provide flotation material for the dock.

The dock as shown employs the pile guide construct for docks according to an embodiment of the invention. The pile guide construct for docks provides a sleeve 2 that is positioned over each pile 14, The sleeve has a somewhat larger inside diameter than the outside diameter of the pile so that the sleeve fits over the pile but the fit is such that the sleeve is not subject to substantial movement relative to the pile, unless there is extremely high water and the sleeves are pulled from the ground as shown in FIG. 2. The sleeve may be attached to the pile.

A guide 6, sometimes called a pile guide, is positioned over the sleeve 2. The pile guide has a cuff 4 having an inside diameter that is larger than the outside diameter of the sleeve, and the inside diameter is sufficiently larger than the outside diameter of the cuff of the pile guide to allow the pile guide to freely traverse the sleeve in a vertical fashion. However, horizontal movement of the pile guide is limited by the pile 14 and the sleeve. The pile guide comprises a bracket to permit attachment of the pile guide to the dock. As can be seen in the drawing figures, multiple piles, multiple sleeves, and multiple pile guides are used with a single dock in a typical application.

Thermoplastic, such as high density polyethylene, is preferred to be used to fabricate the sleeve 2 as well as the cuff 4 of the pile guide 6. It is important that the pile guide be able to easily traverse the sleeve with minimal friction between the pile guide and the sleeve. This is particularly desirable because multiple pile guides and piles 14 are used in most applications, and total friction should be minimized. Further, piles are not always driven with the vertical precision suggested by the drawings, increasing the likelihood of binding of the pile guides if friction is not minimized between the pile guide and the pile. Forming the sleeve of thermoplastics, such as high density polyethylene (HDPE), provides materials having low coefficients of friction that facilitate vertical movement of the dock 12 as the water levels in which the dock is employed change. In rough water, vertical movement of the dock can be rapid, requiring low frictional interaction between the pile guide and the sleeve. Further, thermoplastics do not corrode like metal, particularly in saltwater environments. Thermoplastics resist damage from impact compared to other materials like metal or wood. The thermoplastic used to form the sleeve 2 and the cuff 4 of the guide should have smooth surfaces where the sleeve and the cuff contact in order to reduce friction. For this reason, non-polar thermoplastics are preferred. Thermoplastics having a dynamic coefficient of friction on steel of less than 0.26 are preferred. The thermoplastic from which the sleeve 2 and the interior of the cuff 4 should be smooth where these elements engage to reduce friction, and the thermoplastic should yield a coefficient of friction that is similar to HOPE HDPE sliding against HOPE HDPE.

As shown in FIG. 2, even though the dock 12 is below the water surface 16 and has floated vertically along the piles 14, the dock has not been displaced by the high water. A limiting cap 8 is present at or near the top of each of the piles. The limiting cap has a larger outside surface, such as a larger outside diameter, than the inside diameter of the cuff 4 of the guide, and usually an outside diameter that is at least as large as the outside diameter of the cuff of the guide. The limiting cap acts as a stop to prevent the pile guide from exceeding the top of the sleeve in high water or rough water situations. The larger size of the limiting caps that abut the pile guides stops further vertical movement of the pile guides and the dock attached to the pile guides. While the water level in FIG. 2 is shown as being relatively static, in practice, high wave action causes docks to exceed the top of the piles, particularity in storm situations such as hurricanes, and the dock becomes displaced and completely freed from the piles. The limiting cap prevents such displacement. The limiting cap may be formed of thermoplastic, such as high density polyethylene. It is preferred that the cap is attached to the pile in a robust manner such as by employing a large pin, such as a stainless steel pin 20, that is positioned through the entire diameter of the sleeve and cap to hold the limiting cap in place.

Figure 3:
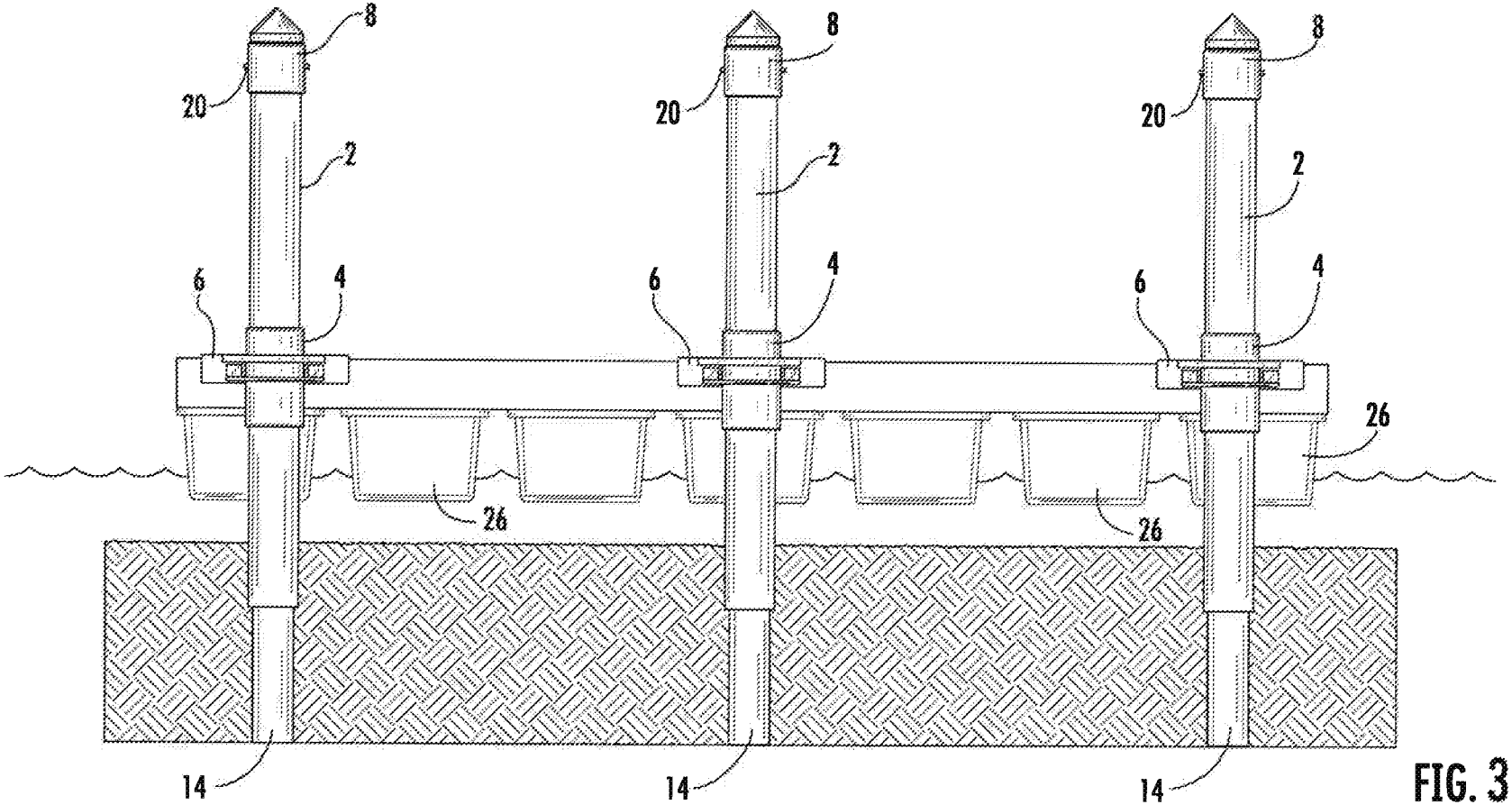
FIG. 3 is an elevation showing the dock of FIG. 2, with a water level that is lower than in FIG. 2.

FIG. 3 demonstrates a low water level situation with the dock 12. FIG. 3 employs the pile guide construct of the invention as shown in FIG. 2. FIG. 3 demonstrates that the water in this position is low, such that the floating dock has moved vertically downward along the piles by means of the pile guides. The sleeves 2 are secured in the ground at a lower end of the sleeves as shown in FIG. 3.

Figure 1:
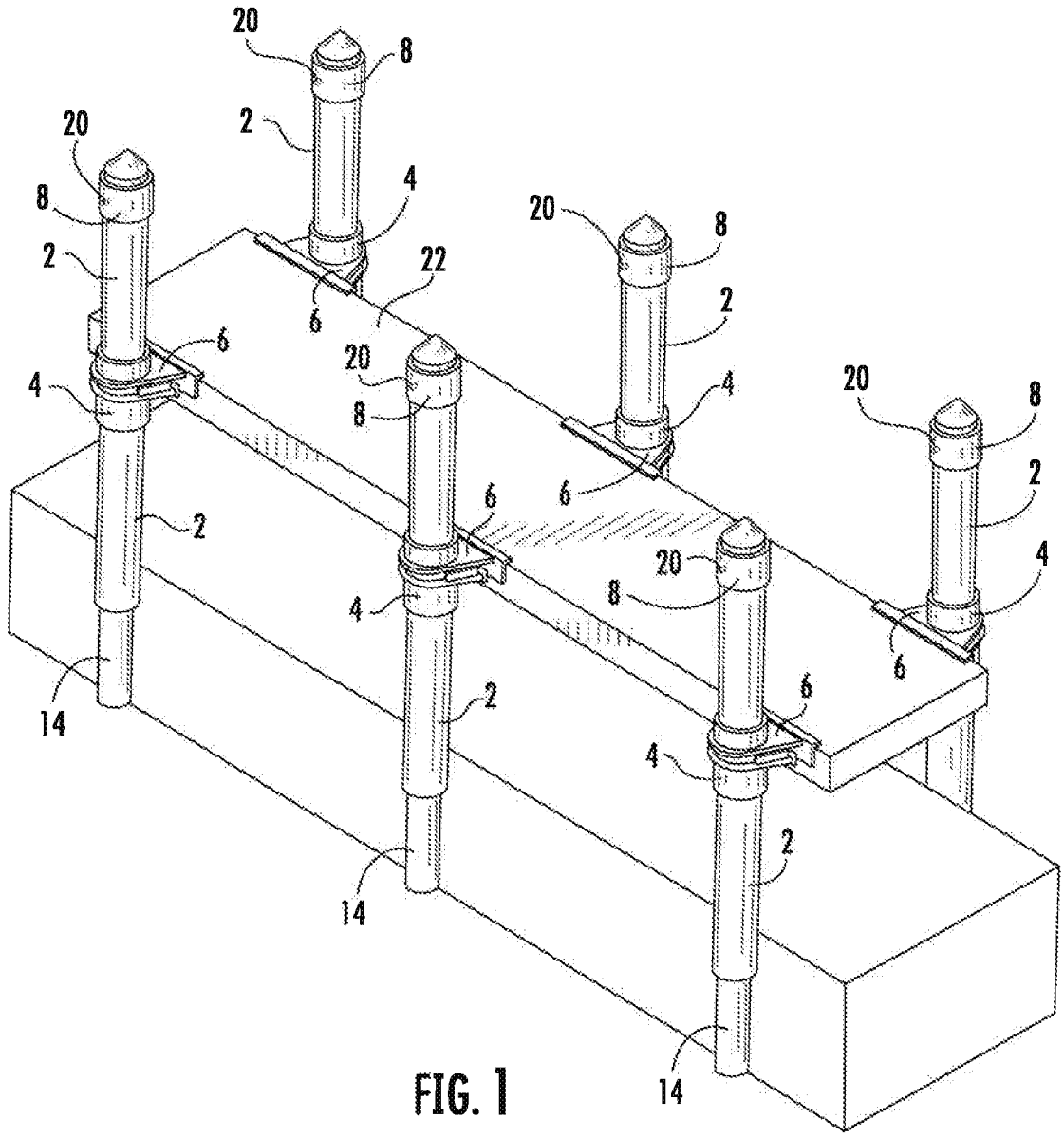
FIG. 1 is a perspective view of a walkway for a dock employing the pile guide construct according to an embodiment of the invention.

FIG. 1 demonstrates the pile guide construct of the invention attached to a walkway 22. The term "dock" as used herein can include walkways and other structures that are used in association with docks and are held in place by piles 14, As shown in FIG. 1, the piles, the sleeve 2, the guide 6 and the limiting cap 8 according to the invention are used with the walkway.

Figure 4:
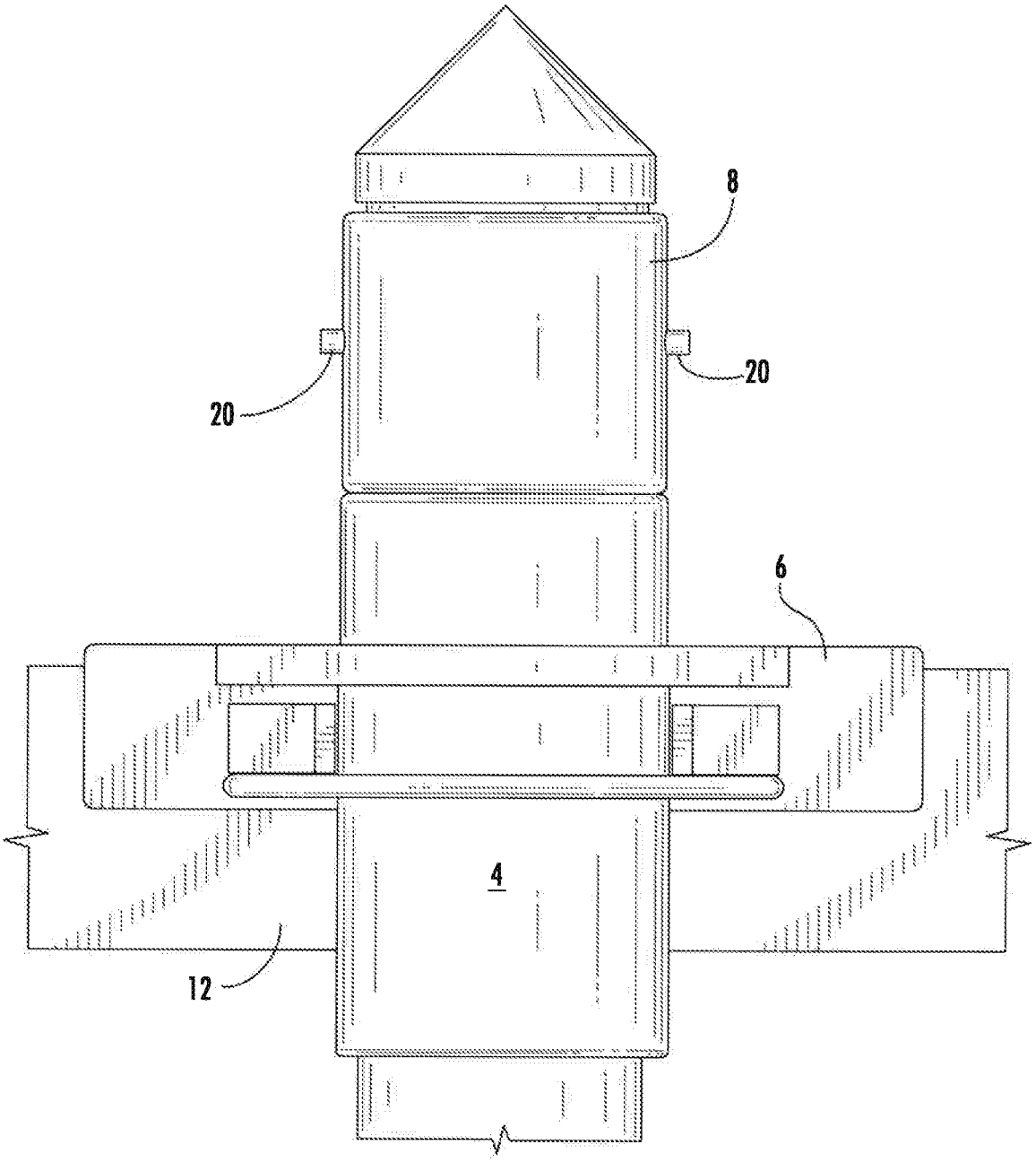
FIG. 4 is an isolation showing the pile guide construct for docks with the limiting cap, and showing the guide with a portion of a sleeve positioned over a portion of a pile.

FIG. 4 shows an enlarged isolation of the guide 6 and the limiting cap 8. The sleeve 2 and dock 12 are shown as partial views. When the water level is high, as shown in FIG. 2, the cuff 4 of the pile guide 6 abuts a stop on an upper end of the pile, which may be the collar on the lower portion of the limiting cap. The force of the floating dock in the high water situation of FIG. 2 pulls the sleeves 2 from the ground (FIG. 3). The sleeves act to extend the useful length of the piles (compare FIG. 2 to FIG. 3). The limiting cap is not attached to the pile so that it can move upwardly when the cuff 4 of pile guide 6 abuts the collar of the limiting cap (FIG. 5) during a high water situation as demonstrated by FIG. 2.

Figure 5:
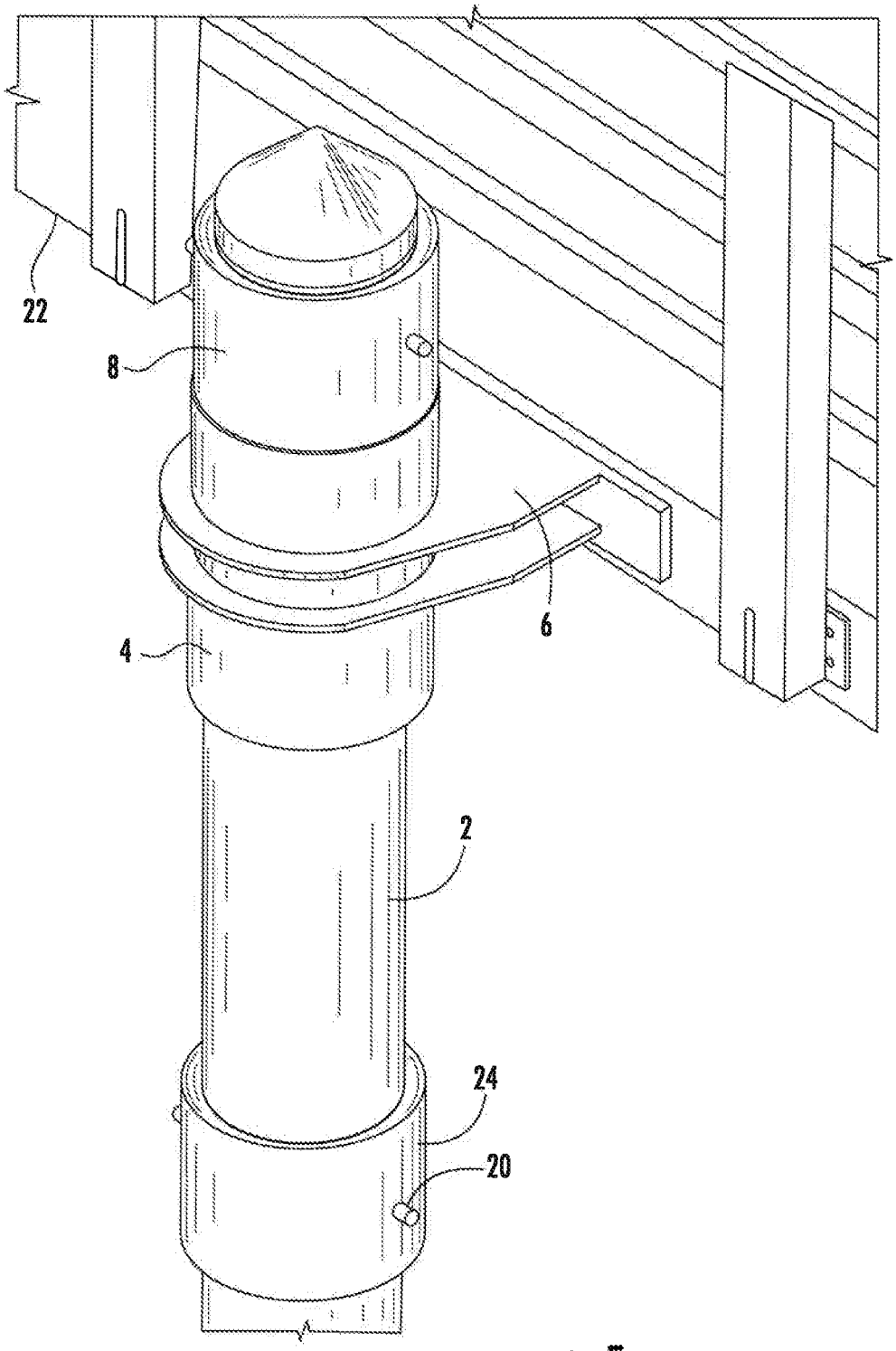
FIG. 5 is a partial view of a dock and pile, showing the limiting cap, the guide and a lower limiting collar.

FIG. 5 shows an embodiment of a pile guide 6 having a cuff 4. The pile guide moves vertically relative to the sleeve 2 that is fitted over the pile 14. Other constructs of pile guides could be used, however, the cuff 4 of the pile guide, no matter the diameter of the configuration, should be formed of a material having a low coefficient of friction, such as a thermoplastic that may be high density polyethylene. The material should also be durable in harsh environments, such as salt water environments, and should be formed so as to vertically traverse freely relative to the sleeve.

Figure 6:
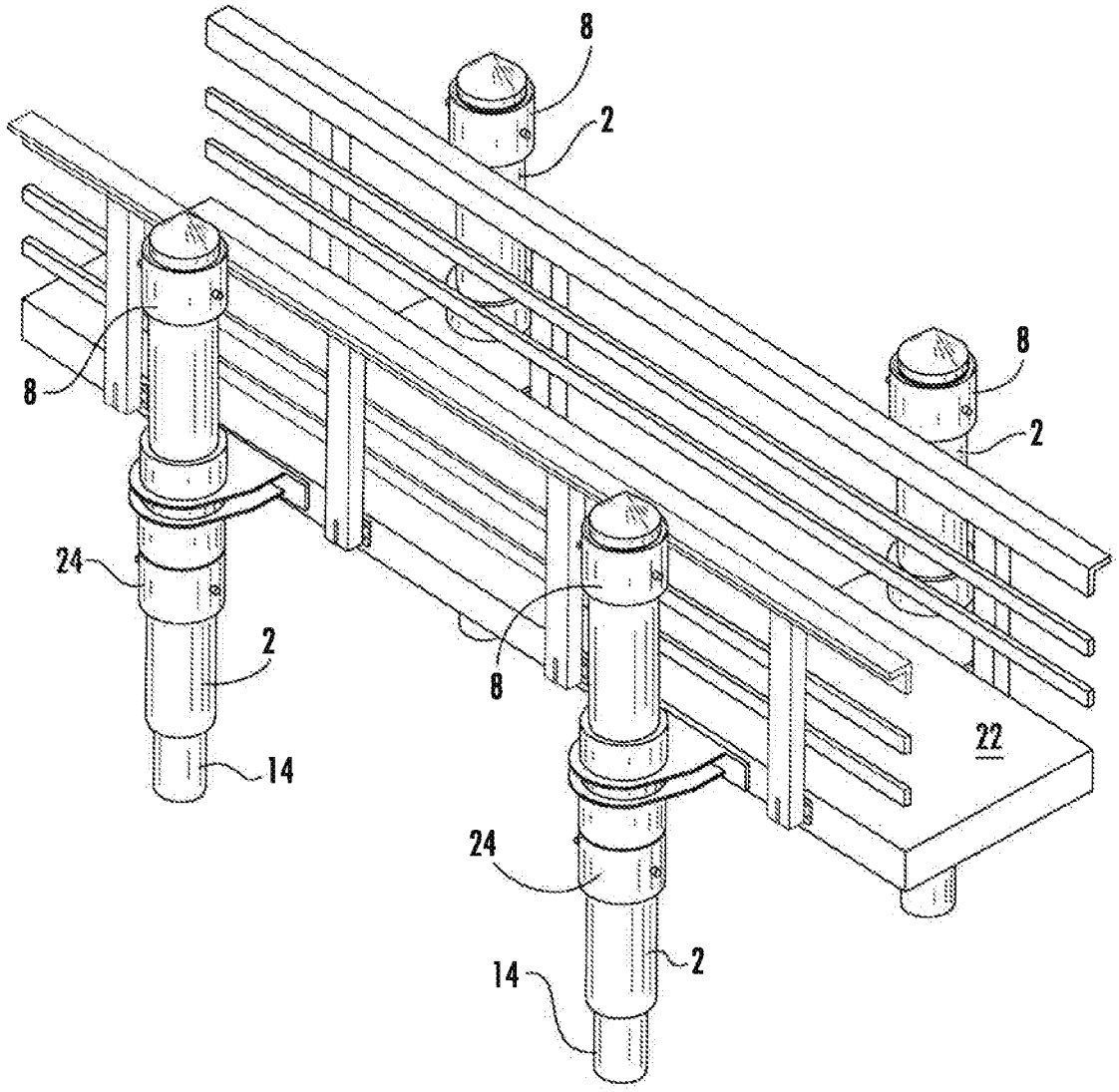
FIG. 6 is a perspective view of a walkway for a dock with the pile guide construct for docks according to an embodiment of the invention.

FIG. 6 shows another embodiment of a walkway 22. The pile guide construct includes the elements of the pile guide construct shown in the drawing figures previously discussed, namely, the sleeves 2 positioned over the piles, the pile guides 6 and the limiting caps 8.

However, the pile guide construct shown in FIG. 6 also includes a limiting collar 24 that is spaced apart from the limiting cap 8. The limiting collar surrounds the sleeves 2. that cover the piles 14, and is positioned on a lower portion of the elongated and vertically positioned sleeves. The limiting collar limits vertical travel of a dock 12 or walkway 22 to a minimum elevation. It should be noted that the walkway in FIG. 6, as is sometimes typical of walkways, does not have floats 26 positioned underneath the walkway. In a low water level situation, the walkway could sink below the surface of the water, depending upon the construct of the walkway and the load on the walkway. The limiting collar prevents the walkway from sinking below the surface of the water, and otherwise limits the walkway from going below a minimal desired height of the walkway. The limiting cap prevents the guide 6 of the walkway from exceeding the maximum height of the piles and retains the walkway in place in high water situations or storms that present substantial wave action.

FIG. 5 isolates elements of the pile guide construct according to the embodiment shown in FIG. 6. The limiting collar 24 that surrounds the elongated and vertically positioned sleeve is spaced apart from the limiting cap 8, both of which are formed of a thermoplastic such as high density polyethylene. A pin 20 of substantial size is driven through the sleeve and the pile to secure the limiting collar. The plurality of limiting collars bears the weight of the dock or walkway and must be securely positioned on the pile and sleeve. As with the limiting cap, the limiting collar has a sufficient outside dimension to prevent travel of the sleeve of the pile guide from traveling past the limiting collar. The limiting collar will have an outside dimension or outside diameter that is greater than the inside diameter of the sleeve of the pile guide and an outside dimension or outside diameter that is at least as large as the outside diameter of the sleeve of the pile guide.

The sleeves 2 may be formed by extruding cylindrical portions and cutting them to the desired length. The cuff 4 may be extruded and cut to length. Other parts may be molded, and welded to extruded parts

What is claimed:

1. A pile guide construct for docks, comprising:

an elongated and vertically positioned sleeve constructed and arranged for positioning over a pile that is driven into the earth and extends above a water line of a body of water;

a guide comprising a cuff that is constructed and arranged to surround the elongated and vertically positioned sleeve and vertically traverse the elongated sleeve, wherein the guide is constructed and arranged for mounting to a dock, and the cuff is formed as tubular member and has a length that extends above and below a member that supports the cuff; and a limiting device positioned at an upper end of the elongated and vertically positioned sleeve, wherein the limiting device has an outside dimension that is greater than an inside diameter of the cuff of the guide.

2. A pile guide construct for docks as described in claim 1, wherein the limiting device has an outside dimension that is greater than the outside diameter of the elongated and vertically positioned sleeve.

3. A pile guide construct for docks as described in claim 1, wherein the sleeve and the cuff of the guide are is-formed of high density polyethylene.

4. A pile guide construct for docks as described in claim 1, wherein the sleeve is formed of high density polyethylene and the cuff of the guide that surrounds the elongated and vertically positioned sleeve is formed of high density polyethylene.

5. A pile guide construct for docks as described in claim 1, further comprising a limiting sleeve positioned spaced apart from the limiting device and positioned on a lower portion of the elongated and vertically positioned sleeve, wherein the limiting sleeve has an outside dimension that is greater than the outside dimension of the elongated and vertically positioned sleeve.

6. A pile guide construct for docks as described in claim 1, further comprising a limiting collar spaced apart from the limiting device and positioned on a lower portion of the elongated and vertically positioned sleeve, wherein the limiting collar has an outside dimension that is greater than an inside diameter of the portion of the guide that surrounds the elongated and vertically positioned sleeve.

7. A pile guide construct for docks as described in claim 1, wherein the sleeve and a cuff of the guide are formed of thermoplastic.

8. A pile guide construct for docks as described in claim 1, wherein the limiting device is a cap that is attached to the sleeve.

9. A pile guide construct for docks as described in claim 1, wherein the limiting device is a cap that is attached to the sleeve and the cap covers a top opening of the sleeve.

10. A pile guide construct for docks as described in claim 1, wherein the limiting device is a cap that is attached to the sleeve and the cap rests on the pile when the cap is not in contact with the cuff.

11. A pile guide construct for docks as described in claim 1, wherein the cap has a conical shape.

12. A pile guide construct for docks, comprising:

an elongated and vertically positioned sleeve constructed and arranged for positioning over a pile that is driven into the earth and extends above a water line of a body of water;

a guide comprising a cuff that is constructed and arranged to surround the elongated and vertically positioned sleeve and vertically traverse the elongated sleeve, wherein the guide is constructed and arranged for mounting to a dock; and a limiting device positioned at an upper end of the elongated and vertically positioned sleeve, wherein the limiting device has an outside dimension that is greater than an inside diameter of the cuff of the guide and wherein the limiting device is a cap that is attached to the sleeve and the cap covers a top opening of the sleeve.

13. A pile guide construct for docks as described in claim 12, wherein the sleeve and the cuff of the guide are formed of high density polyethylene.

14. A pile guide construct for docks as described in claim 12, wherein the sleeve is formed of high density polyethylene and the cuff of the guide that surrounds the elongated and vertically positioned sleeve is formed of high density polyethylene.

15. A pile guide construct for docks as described in claim 12, further comprising a limiting sleeve positioned spaced apart from the limiting device and positioned on a lower portion of the elongated and vertically positioned sleeve, wherein the limiting sleeve has an outside dimension that is greater than the outside dimension of the elongated and vertically positioned sleeve.

16. A pile guide construct for docks as described in claim 12, further comprising a limiting collar spaced apart from the limiting device and positioned on a lower portion of the elongated and vertically positioned sleeve, wherein the limiting collar has an outside dimension that is greater than an inside diameter of the portion of the guide that surrounds the elongated and vertically positioned sleeve.

17. A pile guide construct for docks as described in claim 12, wherein the sleeve and a cuff of the guide are formed of thermoplastic.

18. A pile guide construct for docks as described in claim 12, wherein the cap rests on the pile when the cuff is not in contact with the cap.

19. A pile guide construct for docks as described in claim 12, wherein the cap has a conical shape.

* * * * *